US005145574A

United States Patent [19]

Hedrick

[11] Patent Number: 5,145,574

[45] Date of Patent: Sep. 8, 1992

[54] PROCESS FOR SEPARATING A RESIN PHASE FROM A SOLVENT SOLUTION CONTAINING A SOLVENT, DEMETALLIZED OIL AND A RESIN

[75] Inventor: Brian W. Hedrick, Rolling Meadows, Ill.

[73] Assignee: UOP, Des Plaines, Ill.

[21] Appl. No.: 653,918

[22] Filed: Feb. 12, 1991

[51] Int. Cl.[5] ..... B01D 11/04; C01G 21/14

[52] U.S. Cl. ..... 208/45; 208/309; 165/113

[58] Field of Search ..... 208/45, 309; 165/113

[56] References Cited

U.S. PATENT DOCUMENTS

| | | | |
|---|---|---|---|
| 2,213,798 | 9/1940 | Anne | 208/309 |
| 2,650,897 | 9/1953 | Woerner | 208/45 |
| 4,088,540 | 5/1978 | Bunas | 208/309 |

*Primary Examiner*—Albert W. Davis, Jr.

*Attorney, Agent, or Firm*—Thomas K. McBride; John G. Tolomei; John G. Cutts, Jr.

[57] ABSTRACT

A process for separating a resin phase from a solvent solution containing a solvent, demetallized oil and resin which process comprises: (a) passing the solvent solution over a portion of a generally vertically positioned heat-exchange surface thereby heating the solvent solution to precipitate a resin phase; (b) heating an upper portion of the vertically positioned heat-exchange surface with a circulating hot heat-exchange fluid; (c) passing at least a portion of the resin phase which is precipitated on the upper portion of the vertically positioned downwardly over a lower portion of the vertically positioned heat-exchange surface which lower portion is maintained at a lower temperature than the temperature of the upper portion; (d) recovering the solvent solution having a reduced concentration of resin; and (e) recovering a resin phase.

4 Claims, 1 Drawing Sheet

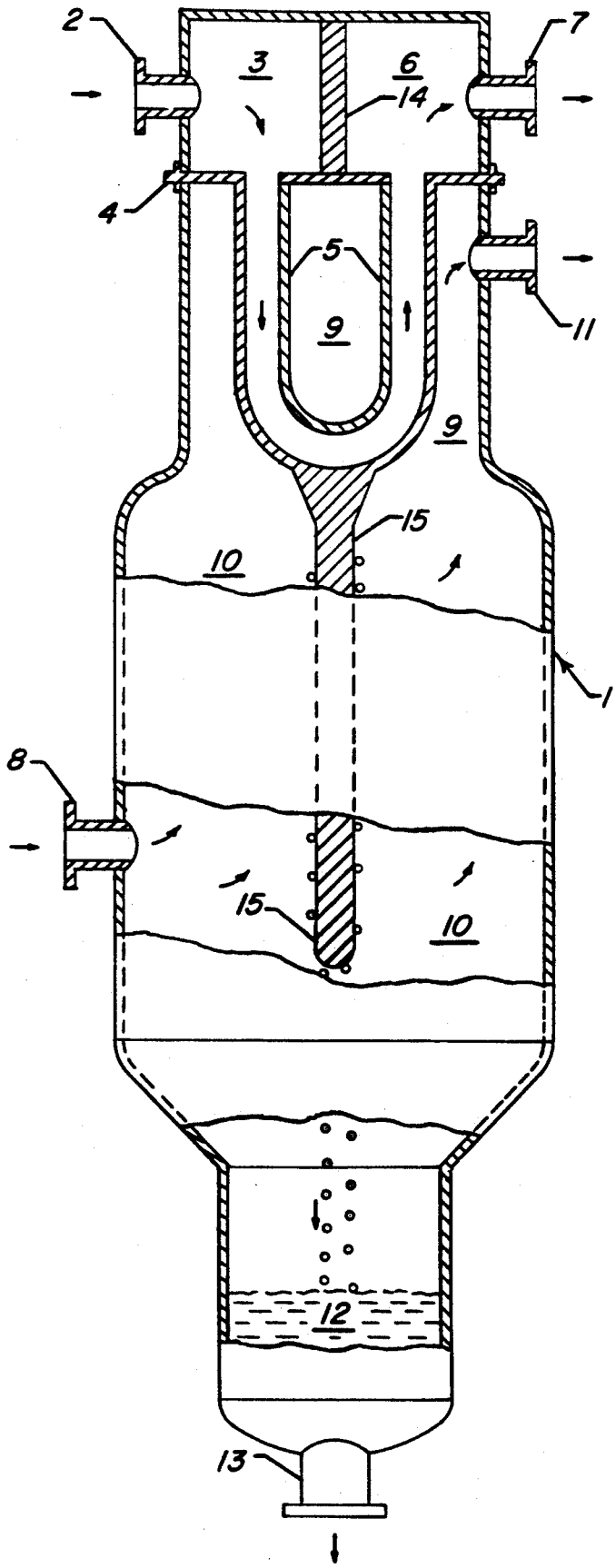
2
7
3
6
14
4
5
11
9
9
15
10
1
8
15
10
12
13

PROCESS FOR SEPARATING A RESIN PHASE FROM A SOLVENT SOLUTION CONTAINING A SOLVENT, DEMETALLIZED OIL AND A RESIN

BACKGROUND OF THE INVENTION

The field of art to which this invention pertains is the removal of hydrocarbon-insoluble asphaltenic material and carbometallic compounds from hydrocarbonaceous charge stocks containing these undesirable contaminants. More specifically, the invention is directed toward a process for deasphalting and demetallizing atmospheric tower bottoms, vacuum tower bottoms (vacuum residuum), crude oil residuum, topped crude oils, coal oil extract, shale oils, all of which generally contain varying quantities of asphaltenic material and carbometallic compounds. Even more specifically, the invention relates to a method for separating a resin phase from a solvent solution containing a solvent, demetallized oil and resin. Such a solvent solution is usually generated during the overall process of deasphalting and demetallizing a heavy residual hydrocarbonaceous feed stream.

INFORMATION DISCLOSURE

The prior art proliferates in a wide spectrum of deasphalting and demetallizing processes for the removal of hydrocarbon-insoluble asphaltenic material and carbometabolic compounds from a heavy residual hydrocarbon feed stream.

BRIEF SUMMARY OF THE INVENTION

The invention provides an improved process for separating a resin phase from a solvent solution containing a solvent, demetallized oil and resin by means of passing the solvent solution over a generally vertically positioned heat-exchange surface thereby heating the solvent solution to precipitate a resin phase, recovering the solvent solution having a reduced concentration of resin and also recovering the resin phase which is produced. In accordance with the present invention, the generally vertically positioned heat-exchange surface has an upper portion which contains a circulating hot heat-exchange fluid and a lower portion which is only remotely heated by the circulating hot heat-exchange fluid and serves as a surface for the condensed resin to continue moving in a downward direction. Since the lower portion of the heat-exchange surface is unheated except for conduction, the bottom end of the lower portion tends to have a temperature approaching the temperature of the surrounding continuous fluid phase. As a result, the condensed resin flows downward over the lower portion of the heat-exchange surface and the resin temperature tends toward equilibrium with the surrounding continuous fluid phase and only the heaviest resin material drips off the ends to be recovered from the heat-exchange vessel. Important advantages of the improved process are the enhanced ability to readily produce a new liquid phase by means of a temperature change within a heat-exchanger having certain novel design characteristics and the ability to take advantage of resin forming a separate phase on the hot surface of the heat-exchanger then permitting the resin to flow down the heat-exchanged surface to a low velocity, continuous phase region of the vessel before dripping from the bottoms of the heat-exchanged surfaces. The preferred contemplated low velocity region is located towards the bottom of the heat-exchange vessel and below the feed inlet.

One embodiment of the invention may be characterized as a process for separating a resin phase from a solvent solution containing a solvent, demetallized oil and resin which process comprises: (a) passing the solvent solution over a portion of a generally vertically positioned heat-exchange surface thereby heating the solvent solution to precipitate a resin phase; (b) heating an upper portion of the vertically positioned heat-exchange surface with a circulating hot heat-exchange fluid; (c) passing at least a portion of the resin phase which is precipitated on the upper portion of the vertically positioned downwardly over a lower portion of the vertically positioned heat-exchange surface which lower portion is maintained at a lower temperature than the temperature of the upper portion; (d) recovering the solvent solution having a reduced concentration of resin; and (e) recovering a resin phase.

Another embodiment of the invention may be characterized as a heat-exchange apparatus for separating a resin phase from a solvent solution containing a solvent, demetallized oil and resin which comprises: (a) at least one generally vertically positioned heat-exchange surface having an upper portion and a lower portion; (b) an inlet for directing the flow of the solvent solution over a portion of the heat-exchange surface; (c) a means for heating the upper portion of the vertically positioned heat-exchange surface with a circulating hot heat-exchange fluid thereby heating the solvent solution to precipitate a resin phase; (d) a means for heating the lower portion of the vertically positioned heat-exchange surface by conduction of heat from the upper portion of the vertically positioned heat-exchange surface; (e) an outlet means for recovering a solvent solution having a reduced concentration of resin; and (f) an outlet means for recovering a resin phase from a lower portion of the heat-exchange apparatus.

Other embodiments of the present invention encompass further details such as preferred feedstocks and operating conditions, all of which are hereinafter disclosed in the following discussion of each of these facets of the invention.

BRIEF DESCRIPTION OF THE DRAWING

The drawing is a vertical cross-section of a preferred embodiment of the present invention.

DETAILED DESCRIPTION OF THE INVENTION

When the chronological history of the art of solvent deasphalting is traced, it becomes apparent that those having the requisite expertise recognize the benefits of separating a resin phase from a solvent solution containing a solvent, demetallized oil and resin which solvent solution is derived from a low value residual feedstock.

The present invention provides an improved process for the production and separation of a resin phase from a solvent solution containing a solvent, demetallized oil and resin.

In accordance with the present invention, suitable residual feedstocks which may be used to prepare the solvent solution utilized in the present invention include, for example, atmospheric tower bottoms, vacuum tower bottoms, crude oil, topped crude oils, coal oil extract, shale oils, and oils recovered from tar sands.

The solvent solution which is used as the feed to the present invention is prepared by countercurrently contacting a residual feed stream with a hydrocarbon-selective solvent, in a solvent extraction zone, at extraction conditions selected to produce a solvent-lean asphaltic stream and a solvent-rich hydrocarbon stream containing demetallized oil and resin. The solvent extraction zone will preferably function at temperatures of about 50° F. to about 600° F. the pressure will be maintained within the range of about 100 to about 1,000 psig. The solvent/residual oil volumetric ratio will be in the range of about 2:1 to about 30:1. Judicious procedures involve the selection of temperature and pressure to maintain the extraction operations in liquid phase.

Suitable solvents include those utilized by the prior art deasphalting techniques and it is contemplated that the solvent will be selected from the group of light hydrocarbons including ethane, propane, butane, isobutane, pentane, isopentane, neopentane, hexane, isohexane, heptane, and the mono-olefinic counterparts thereof. Furthermore, the solvent may be a normally liquid naphtha fraction containing hydrocarbons having from about 5 to about 14 carbon atoms per molecule, and preferably a naphtha distillate having an end boiling point below about 200° F. With respect to the group of light hydrocarbons containing from about 3 to about 7 carbon atoms per molecule, preferred techniques dictate the utilization of a mixture thereof. For example, suitable solvent mixtures will comprise normal butane and isopentane, propane and normal butane, normal butane and normal pentane, for example.

The asphaltic residual feed stream is introduced into an extraction zone in a downwardly direction and therein contacts an upwardly flowing solvent stream. A solvent-lean asphaltic stream is withdrawn from the extraction zone at a location in the lower portion thereof. A solvent solution containing a solvent, demetallized oil and resin is removed from an upper location in the extraction zone. This resulting solvent solution is the feedstock which is introduced into the heat-exchange apparatus utilized in the present invention.

In accordance with the present invention, a solvent solution containing a solvent, demetallized oil and resin is introduced into a heat-exchange apparatus and directed over at least a portion of a generally vertically positioned heat-exchange surface thereby heating the solvent solution to precipitate a resin phase. After the flowing stream is heated to precipitate a resin phase, the flow of the solvent solution having a reduced concentration of resin is recovered from the heat-exchange apparatus. At least a portion of the precipitated resin is formed on the heat-exchange surface and flows downward via gravity towards the lower end of the heat-exchange surface which has a lower temperature than the upper portion of the heat-exchange surface resulting in the recovery of only the heaviest resin material as a resin product stream from the heat-exchange apparatus. The downwardly flowing resin drips from the bottom end of the heat-exchange surface and pools in the bottom of the heat-exchange apparatus. The precipitated resin phase is recovered from a lower region of the heat-exchange apparatus. By means of the heat-exchange apparatus of the present invention, a selected resin phase is able to be recovered.

The heat-exchange apparatus of the present invention utilizes the advantage of resin forming a separate phase on the hottest surface (upper heat-exchange surfaces) then flowing down the walls of the heat-exchange surfaces to a low velocity, continuous phase region of the vessel before dripping from the bottoms of the heat-exchange surfaces.

In accordance with the present invention, the heat-exchange surfaces are preferably U-shaped, circular cross-sectioned tubes made from conventional metals such as, for example, steel, and may be designed and made by conventional methods known to those skilled in the design of heat-exchangers. The outer surfaces of the heat-exchange tubes (those directly contacting the solvent solution) are preferably smooth, as opposed to having baffles or other enhanced surfaces in order to encourage the unimpeded flow of the resin phase down the tubes and into the pool of resin in the lower portion of the heat-exchanger vessel. The heat-exchange tubes are located in the upper portion of the heat-exchange surface and heated by the circulation of a hot heat-exchange fluid. In the lower portion of the heat-exchange surface, the heat-exchange surface is attached to the heat-exchange tubes and extends downwardly, and is heated by conduction from the upper portion of the heat-exchange surface. In a preferred embodiment of the present invention, the length of the tube bundle is from about 15 feet to about 50 feet, and the quantity of tubes in a bundle is determined by the amount of heat transfer required in a particular application. The length of heat-exchange surface extending below the heat-exchange tubes is from about 10 feet to 20 feet. The heat-exchange surface located in the lower portion preferably has a circular cross-section, may be attached in any convenient manner to allow the conduction of heat from the heat-exchange tubes located in the upper portion of the heat-exchange surface and is preferably constructed from the same material as the heat-exchange tubes, such as steel, for example.

The heat-exchange medium which is utilized to transfer heat to the solvent solution containing a solvent, demetallized oil and resin may be any suitable hot fluid but is preferably the solvent which is used in the overall process. The heating medium is preferably introduced at a temperature from about 250° F. (121° C.) to about 450° F. (232° C.).

In accordance with the present invention, preferred operating conditions include a resin precipitation temperature from about 200° F. (93° C.) to about 390° F. (200° C.) and pressure from about 500 psig (3447 kPa gauge) to about 640 psig (4413 kPa gauge), and an average linear velocity of the flowing solvent solution containing demetallized oil from about 1cm/second to about 10cm/second. The operating conditions will vary with the characteristics of the feed, the selected solvent, the desired characteristics of the demetallized oil and the actual configuration of the apparatus, and will be readily selected to achieve the desired results by an artisan while using the disclosure herein.

DESCRIPTION OF THE DRAWING

As illustrated in the drawing, the apparatus of the present invention comprises heat-exchange vessel 1 having a hot heat-exchange fluid inlet 2 whereby hot heat-exchange fluid is introduced into manifold 3 which directs the hot heat-exchange fluid into a generally vertically oriented heat-exchange tube 5. The heat-exchange fluid exits heat-exchange tube 5 and enters into manifold 6 and is subsequently removed from heat-exchange vessel 1 via cold heat-exchange fluid outlet 7. Barrier 14 is utilized to separate manifold 3 from manifold 6 which ensures that the flowing heat-exchange fluid is conducted through heat-exchange tube 5. Tube sheet 4 is utilized in a conventional manner to serve as a partition and to support heat-exchange tube 5. Drip leg 15 is attached to the lower end of heat-exchange tube 5. Cold solvent solution inlet 8 is used to introduce a cold solvent solution containing demetallized oil and resin into heat-exchange zone 10 and heat-exchange zone 9. The cold solvent solution is directed in a generally upward direction while contacting heat-exchange tube 5 to thereby heat the flowing cold solvent solution which precipitates a resin phase. At least a portion of the precipitated resin flows downwardly on the surface of heat-exchange tube 5 and continues down the surface of drip leg 15. The resulting heated solvent solution having a reduced concentration of resin exits heat-exchange zone 9 via hot solvent solution outlet 11. The resin phase which is precipitated from the flowing solvent solution is collected in the bottom of heat-exchange zone 10 in a resin phase 12. The resulting resin phase is removed from heat-exchange vessel 1 via resin phase outlet 13.

The process of the present invention is further demonstrated by the following illustrative embodiment. This illustrative embodiment is, however, not presented to unduly limit the process of this invention, but to further illustrate the advantages of the hereinabove described embodiments. The following data were not obtained by the actual performance of the present invention, but are considered prospective and reasonably illustrative of the expected performance of the invention.

ILLUSTRATIVE EMBODIMENT

In a commercially designed process unit of 15,000 barrels per day capacity, the apparatus for separating a resin phase from a solvent solution containing a solvent, demetallized oil and resin, a vertical cylindrical outer vessel is employed having a diameter of 3.8 meters and a length or height of 17 meters. The solvent solution inlet pipe diameter is 41cm and solvent solution outlet pipe diameter is 41cm. The resin phase outlet pipe diameter is 41cm. The heating medium inlet and outlet pipe diameter is 41cm. The heat-exchange tubes located within the outer vessel have an average length of 6 meters and have a combined heat-exchange surface of 3000 $m^2$. The average length of the drip legs is 5 meters. The average linear velocity around the heat-exchange tubes is about 5cm/sec.

The solvent solution containing a solvent, demetallized oil and resin is introduced into the heat-exchanger at a temperature from about 225° F. (107° C.) to about 289° F. (143° C.) and a pressure from about 550 psig (3792 kPa gauge) to about 600 psig (4137 kPa gauge). This solvent solution is heated to increase the temperature thereof by about 70° F. (21° C.) to about 90° F. (32° C.).

A solvent solution containing solvent and demetallized oil is recovered for the subsequent recovery of the solvent for recycle and demetallized oil for use elsewhere.

A resin stream in an amount of 8 liquid volume percent of the feed is recovered from the apparatus.

The foregoing description, drawing, and illustrative embodiment clearly demonstrate the advantages encompassed by the process of the present invention and the benefits to be afforded with the use thereof.

What is claimed:

1. A process for separating a resin phase from a solvent solution containing a solvent, demetallized oil and resin which process comprises:

(a) passing the solvent solution over a portion of a generally vertically positioned heat-exchange surface thereby heating said solvent solution to precipitate a resin phase;

(b) heating an upper portion of said vertically positioned heat-exchange surface with a circulating hot heat-exchange fluid;

(c) passing at least a portion of said resin phase which is precipitated on said upper portion of said vertically positioned downwardly over a lower portion of said vertically positioned heat-exchange surface which lower portion is maintained at a lower temperature than the temperature of said upper portion;

(d) recovering said solvent solution having a reduced concentration of resin; and (e) recovering a resin phase.

2. The process of claim 1 wherein said solvent is comprised of at least one component selected from the group consisting of ethane, propane, butane, isobutane, pentane, isopentane, neopentane, hexane, isohexane, heptane and the mono-olefinic counterparts thereof.

3. The process of claim 1 wherein said solvent solution is prepared from a residual feedstock comprised of at least one component selected from the group consisting of atmospheric tower bottoms, vacuum tower bottoms, crude oil, topped crude oil, coal oil extract, shale oil and oil recovered from tar sands.

4. The process of claim 1 wherein said resin is precipitated from said solvent solution containing a solvent, demetallized oil and resin at conditions which include a temperature from about 200° F. (93° C.) to about 390° F. (200° C.), a pressure from about 500 psig (3447 kPa gauge) to about 640 psig (4413 kPa gauge) and an average linear velocity around the heat-exchange tubes of the flowing solvent solution containing demetallized oil from about 1cm/second to about 10cm/second.

* * * * *